US009868124B2

(12) United States Patent
Ballhause

(10) Patent No.: US 9,868,124 B2
(45) Date of Patent: Jan. 16, 2018

(54) CENTRIFUGE VESSEL ASSEMBLY

(71) Applicant: Thermo Electron LED GmbH, Langenselbold (DE)

(72) Inventor: Norman Ballhause, Windhausen (DE)

(73) Assignee: Thermo Electron LED GmbH, Langenselbold (DE)

( * ) Notice: Subject to any disclaimer, the term of this patent is extended or adjusted under 35 U.S.C. 154(b) by 113 days.

(21) Appl. No.: 13/937,288

(22) Filed: Jul. 9, 2013

(65) Prior Publication Data

US 2014/0010739 A1 Jan. 9, 2014

(30) Foreign Application Priority Data

Jul. 9, 2012 (DE) ..... 10 2012 013 642

(51) Int. Cl.

| | |
|---|---|
| ***B04B 1/00*** | (2006.01) |
| ***B04B 7/08*** | (2006.01) |
| ***B01L 3/00*** | (2006.01) |
| *B04B 5/04* | (2006.01) |
| *B01L 9/06* | (2006.01) |

(52) U.S. Cl.

CPC ..... *B04B 7/08* (2013.01); *B01L 3/5021* (2013.01); *B01L 9/06* (2013.01); *B01L 2300/0851* (2013.01); *B01L 2300/123* (2013.01); *B04B 2005/0435* (2013.01)

(58) Field of Classification Search

CPC ..... B01L 3/50; B01L 3/5021; B04B 5/0414; B04B 2005/0435

USPC ..... 422/72, 547, 548, 560, 561, 562

See application file for complete search history.

(56) References Cited

U.S. PATENT DOCUMENTS

| | | | | |
|---|---|---|---|---|
| 3,578,240 | A * | 5/1971 | Eberle | B01L 3/5021 422/918 |
| 6,866,622 | B2 * | 3/2005 | Aizawa | 494/20 |
| 8,215,508 | B2 | 7/2012 | Baird et al. | |

(Continued)

FOREIGN PATENT DOCUMENTS

| | | |
|---|---|---|
| CN | 201193997 Y | 2/2009 |
| DE | 20 2005 015 644 U1 | 2/2007 |

(Continued)

OTHER PUBLICATIONS

English Machine Translation of German Patent No. DE 20 2005 015 644 U1, published Feb. 15, 2007 (4 pages).

(Continued)

*Primary Examiner* — Jill Warden
*Assistant Examiner* — Dwayne K Handy
(74) *Attorney, Agent, or Firm* — Wood Herron & Evans LLP

(57) ABSTRACT

The present invention relates to a centrifuge vessel assembly for use in a centrifuge, comprising a centrifuge vessel for holding a sample to be centrifuged, an adapter holding the centrifuge vessel, and a holding means holding the adapter for attaching the centrifuge vessel assembly to a rotor of the centrifuge, said centrifuge vessel having a vessel body and a sealable opening through which the sample to be centrifuged can be filled into said vessel, said vessel body having a cross-sectional area and a vessel height, said vessel height being oriented at right angles to said cross-sectional area, wherein said cross-sectional area is in the form of an oval cross-sectional area.

9 Claims, 4 Drawing Sheets

(56) References Cited

U.S. PATENT DOCUMENTS

| | | | | |
|---|---|---|---|---|
| 2004/0209755 | A1* | 10/2004 | Moore et al. | 494/20 |
| 2005/0112033 | A1* | 5/2005 | Zhang et al. | 422/102 |
| 2007/0077655 | A1* | 4/2007 | Unger et al. | 435/404 |
| 2011/0130263 | A1 | 6/2011 | Del Vecchio | |
| 2011/0319247 | A1 | 12/2011 | Kitazawa et al. | |

FOREIGN PATENT DOCUMENTS

| | | | |
|---|---|---|---|
| JP | 46-22304 | | 8/1971 |
| JP | 51-21760 | | 6/1976 |
| JP | 06218299 | A | 8/1994 |
| JP | 2001-162192 | A | 6/2001 |
| JP | 2007-151468 | A | 6/2007 |
| JP | 2012-101138 | A | 5/2012 |
| JP | 2012-115829 | A | 6/2012 |

OTHER PUBLICATIONS

Searching Paj, English Machine Translation of Patent Abstracts of Japan for Publication No. 2001-162192, published Jun. 19, 2001, retrieved from http://www19.ipdl.inpit.go.jp/PA1/cgi-bin/PA1INDEX on Sep. 19, 2014 (1 page).

Searching Paj, English Machine Translation of Publication No. 2007-151468, published on Jun. 21, 2007, retrieved from http://www19.ipdl.inpit.go.jp (10 pages).

Searching Paj, English Machine Translation of Publication No. 2012-101138, published on May 31, 2012, retrieved from http://www19.ipdl.inpit.go.jp (8 pages).

Searching Paj, English Machine Translation of Patent Abstracts of Japan, Publication No. 2012-115829, published on Jun. 21, 2012, retrieved from http://www19.ipdl.inpit.go.jp/PA1/cgi-bin/PA1INDEX on Sep. 19, 2014 (2 pages).

Espacenet, English Machine Translation of JPH06218299A, published on Aug. 9, 1994, retrieved from http://worldwide.espacenet.com on Jul. 28, 2015 (4 pages).

Espacenet, English Machine Translation of CN201193997Y, published on Feb. 11, 2009, retrieved from http://worldwide.espacenet.com on Jul. 28, 2015 (5 pages).

* cited by examiner

Fig. 4A
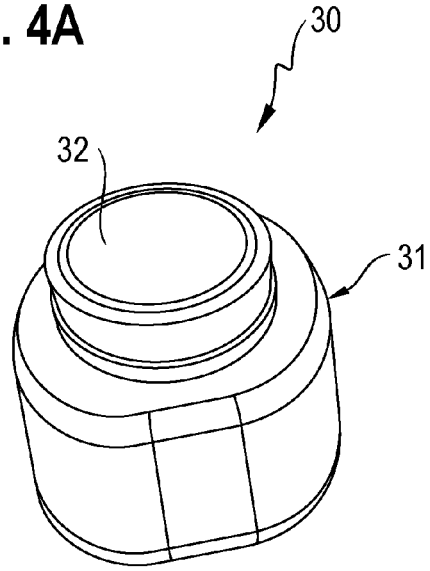
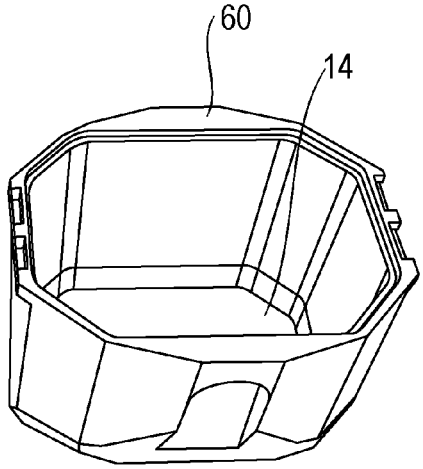
Fig. 4C
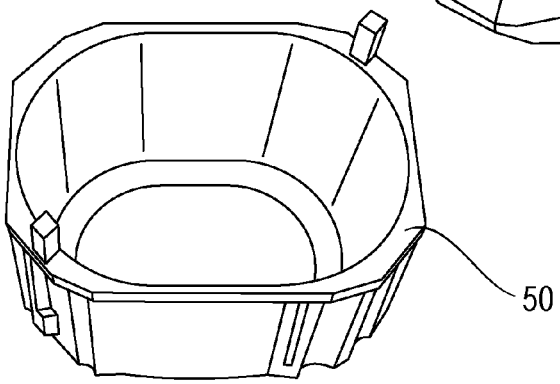
Fig. 4B

CENTRIFUGE VESSEL ASSEMBLY

CROSS-REFERENCE TO RELATED APPLICATIONS

The present application claims priority under 35 U.S.C. §119 of German Patent Application No. 10 2012 013 642.0, filed Jul. 9, 2012, the disclosure of which is hereby incorporated herein by reference in its entirety.

FIELD OF THE INVENTION

The present invention relates to a centrifuge vessel assembly for use in a centrifuge, comprising a centrifuge vessel for holding a sample to be centrifuged, an adapter holding the centrifuge vessel, and a holding means holding the adapter for attaching the centrifuge vessel assembly to a rotor of the centrifuge. The centrifuge vessel has a vessel body and a sealable opening through which the sample to be centrifuged can be filled into said vessel.

BACKGROUND OF THE INVENTION

Centrifuge vessels, sample containers, and centrifuge bottles are special containers comprising a vessel body and a closable opening for use in a centrifuge. In a centrifuge, liquid mixtures, for example, are separated by implementation of high acceleration forces. To this end, a mixture to be separated is placed in a centrifuge vessel, which is then driven to rotate in such a manner that centrifugal forces within the centrifuge vessel cause separating processes to take place. By this means, individual liquids can be separated from each other or solid particles from liquids. On account of the high acceleration values, very high forces act on the centrifuge vessel and its contents, so that the centrifuge vessels must show a high degree of mechanical stability.

A centrifuging process is to a certain extent time consuming. In order to reduce the time taken to process a given batch, it would be desirable to have centrifuge vessels that are of as great a capacity as possible. However, limits are set on account of the high acceleration forces that occur during centrifugation. In order to prevent the centrifuge vessels from being damaged or destroyed, use has hitherto been made of bottles having a circular cross-sectional area and a capacity of 750 milliliters. Furthermore, square type flasks of a similar capacity are presently in use, which can be employed without an adapter directly in a cup or in bottle holding means for subsequent centrifugation. Such centrifuge vessels have a greater capacity due to their corners, but they are more difficult to clean. This is a drawback, since the centrifuge vessels will often be used a number of times to save on costs. However, the cost should not be enhanced by an increased effort required for cleaning. Another disadvantage of such square type centrifuge vessels is the fact that after centrifugation residues of the sample remain in the corners and the yield of the sample is thus diminished.

SUMMARY OF THE INVENTION

It is an object of the present invention to provide a centrifuge vessel which is capable of withstanding high acceleration values during centrifugation and at the same time has a large capacity without giving rise to cleaning problems and losses of yield.

This object is achieved with a centrifuge vessel assembly for use in a centrifuge, comprising a centrifuge vessel for holding a sample to be centrifuged, an adapter holding the centrifuge vessel, and a holding means holding the adapter for attaching the centrifuge vessel assembly to a rotor of the centrifuge. Said centrifuge vessel has a vessel body and a sealable opening through which the sample to be centrifuged can be filled into said vessel. Said vessel body has a cross-sectional area and a vessel height, said vessel height being oriented at right angles to said cross-sectional area, wherein said cross-sectional area is in the form of an oval cross-sectional area.

The centrifuge vessel has a cross-sectional area oriented at right angles to a vessel height of the centrifuge vessel, wherein the cross-sectional area is delimited by a closed oval curve. Thus the centrifuge vessel assembly of the present invention comprises a vessel body, which has at at least one location an oval cross-sectional area oriented perpendicularly or at right angles to a vessel height of the centrifuge vessel. The oval cross-sectional area can be formed geometrically, for example, by a cross-sectional area consisting of two semicircular areas joined together by a rectangular area. Alternatively, the oval cross-sectional area may have an elliptical shape in which the specific closed oval curve is in the form of an ellipse.

Thus the cross-sectional area of the centrifuge vessel is not rotationally symmetrical, as in the prior art, and as has hitherto been avoided, since high forces occur during centrifugation which might destroy the centrifuge vessel. These forces can be kept under control when use is made of the centrifuge vessel assembly of the present invention. On account of its shape, lower forces are set free in the centrifuge vessel than is the case in a centrifuge vessel of comparable capacity but having a greater vessel height. The centrifuge vessel used in the centrifuge vessel assembly of the present invention has the advantage of making it possible to provide a vessel having a high volumetric capacity accompanied by a low overall vessel height. In this way, the prior centrifuges can still be used, since the previous overall vessel height remains unchanged. Furthermore, the centrifuge vessel of the present invention is easy to wash, since it has no corners in its bottom region, and is thus quickly reusable. Furthermore, the centrifuge vessel has no corners at the side walls or in a bottle neck, as might influence the separating results.

The centrifuge vessel can be in the form of a bottle provided with an opening through which the sample to be centrifuged will be filled into the vessel. During the centrifugation process, the centrifuge vessel is sealed, for example, with a lid, which may be provided with a screw-on cap. The centrifuge vessel has, for example, a vessel body made of plastics material. Furthermore the vessel body can be fabricated as a single unit, for example, by blow molding. Moreover, the lid of the centrifuge vessel can be made of plastics material.

Provision may be made for the centrifuge vessel to have a bottom surface displaying the oval cross-sectional area. This has the advantage that the centrifuge vessel will be easy to clean and that no sample residues will remain in the interior of the centrifuge vessel.

In one exemplary embodiment of the centrifuge vessel of the present invention, provision may be made for a middle region of the centrifuge vessel to display the oval cross-sectional area. For this purpose, provision may additionally be made for the centrifuge vessel to have a side wall of a specific height, wherein the oval cross-sectional area remains constant over the entire height, that is to say, does not change over this entire vertical region. In this way, the centrifuge vessel will be easy to clean, since all corners have been obviated in this region. For example, the side wall is disposed in a middle region of the centrifuge vessel.

In a further exemplary embodiment of the centrifuge vessel assembly of the present invention, provision may be made for the centrifuge vessel to have a conical bottom region. Such a region is advantageous, because it avoids corners, which might be a hindrance to the process of washing out the centrifuge vessel. The conical bottom region can likewise have an oval cross-sectional area that diminishes downwardly. Furthermore, provision may be made for the angle of taper to vary along the perimeter of the oval such that no corners are formed in the transition regions adjacent to any oval vertical wall.

Furthermore, provision may be made for the conical bottom region to merge into a side wall that delimits the oval cross-sectional area. Thus the conical bottom region and a middle region of the centrifuge vessel can in each case be in the form of an oval cross-sectional area.

For practical purposes, provision may be made for the centrifuge vessel to have a capacity of from approximately 750 milliliters to approximately 1000 milliliters. Compared with conventional centrifuge vessels, this represents an increase in capacity, which is made possible by the oval design of at least one cross-sectional area in the interior of the centrifuge vessel. By this means, the vessel height of the centrifuge vessel can remain unchanged when compared with conventional centrifuge vessels. Advantageous increases in capacity are thus obtained. The capacity of an oval vessel is, for example, equal to a gain of approximately one third over the capacity of a round bottle of identical overall vessel height. This means that in these embodiments the previous overall vessel height is retained, while the centrifuge vessels of the present invention have an enhanced capacity.

The centrifuge vessel assembly of the present invention, in addition to the oval centrifuge vessel, comprises an adapter holding the vessel and a holding means holding the adapter and allowing fastening of the centrifuge vessel assembly to the rotor of a centrifuge. The centrifuge vessel assembly is preferably used in swinging bucket rotors. Fixing the centrifuge vessel assembly to the rotor can be done in any known and suitable way, such as fastening by bolts and so on. When fixed to the centrifuge rotor, the centrifuge vessel is preferably oriented such that the smaller side of the oval cross-section faces the direction of rotation. That is, the longer axis of the oval cross-section is oriented along the circumferential direction of the rotor and the fixing means, such as bolts, are preferably attached to the holding means at sites neighboring the opposing small sides of the oval centrifuge vessel.

The adapter holding the centrifuge vessel preferably also has an oval cross-section and is made to follow the outer contour of the centrifuge vessel such as to support its outer surface at least in the region of its side walls. The adapter may consist of an elastic material, such as an elastomeric plastics material, which can adapt to the form of the centrifuge vessel and the holding means and can absorb at least some of the centrifugal forces and thus reduce their impact on the centrifuge vessel.

The holding means is adapted to hold and support the adapter in a per se known manner and to fix the centrifuge vessel, supported by the adapter, to the centrifuge rotor. The holding means is preferably made of a rigid material, adapted in form to at least partially surround and support the outer walls of the adapter.

BRIEF DESCRIPTION OF THE DRAWINGS

The present invention is explained in greater detail below with reference to exemplary embodiments. However, the present invention is not restricted to these exemplary embodiments so that further combinations and applications are possible. In the schematic drawings:

FIG. 4 shows the exemplary embodiment as illustrated in FIG. 3 in the demounted state of the centrifuge vessel (FIG. 4A), the adapter (FIG. 4B), and a centrifuge holder (FIG. 4C).

DETAILED DESCRIPTION OF THE INVENTION

Figure 1A:
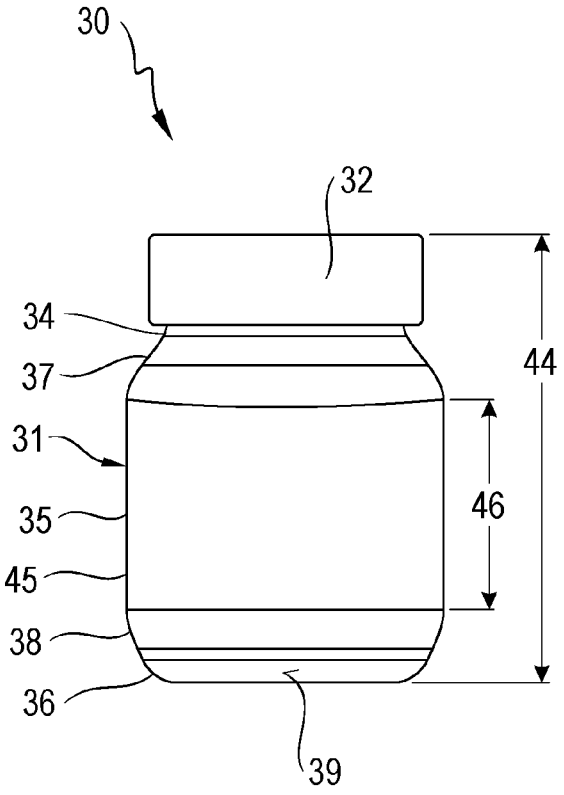
FIG. 1 shows a side view (FIG. 1A) of a first exemplary embodiment of a centrifuge vessel and a top view thereof (FIG. 1 B)
Figure 1B:
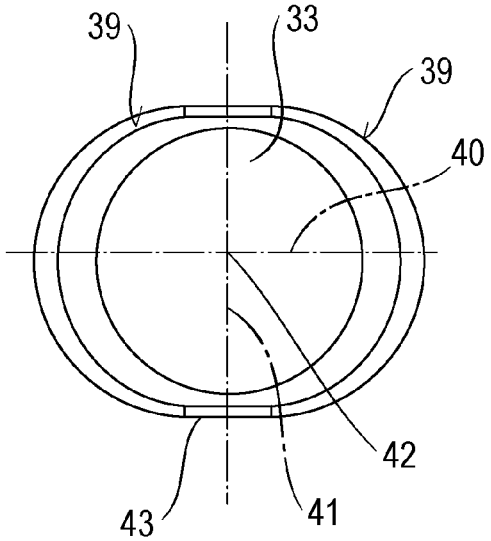

FIG. 1 shows a first exemplary embodiment of a centrifuge vessel 30 in two views, of which FIG. 1A is a side view of the centrifuge vessel 30 and FIG. 1B is a top view of the centrifuge vessel 30. The centrifuge vessel 30 comprises a vessel body 31 comprising an opening that can be sealed by means of a closure element 32 in the form of a screw-on lid. For this purpose, the lid 32 is of a circular cross-section, as shown in FIG. 1B.

FIG. 1A shows the vessel body 31 comprising a top portion 34 located in the proximity of the opening, a middle portion 35, and a bottom portion 36. The top portion 34 merges continuously into the middle portion 35 by way of a first transition zone 37, and the middle portion 35 merges continuously into the bottom portion 36 by way of a second transition zone 38. The vessel body 31 has an oval cross-sectional area 39 in the top portion 34, in the middle portion 35, and in the bottom portion 36, and the bottom portion 36 has a smaller peripheral contour than the middle portion 35. In FIG. 1A, the vessel body 31 comprises a side wall 45 having a wall height 46, and the oval cross-sectional area 39 in the middle portion 35 is constant over the entire wall height 46.

The circular cross-section 33 of the lid 32, the oval cross-section 39 of the top portion 34 and the oval cross-section of the middle portion 35 can be seen in the top view as shown in FIG. 1B. The oval cross-section 39 of the bottom portion 36 that is smaller than the oval cross-section 39 of the middle portion 35 is hidden from view in the top view shown in FIG. 1B and is indicated in FIG. 1A. FIG. 1B shows a longitudinal axis 40 and a transverse axis 41 that meet at a center point 42. The oval cross-sectional areas 39 are formed mirror-symmetrically about the longitudinal axis 40 and the transverse axis 41. The oval cross-sectional areas 39 are formed geometrically by two semicircular areas that are joined together by means of a rectangular area 43.

Figure 2A:
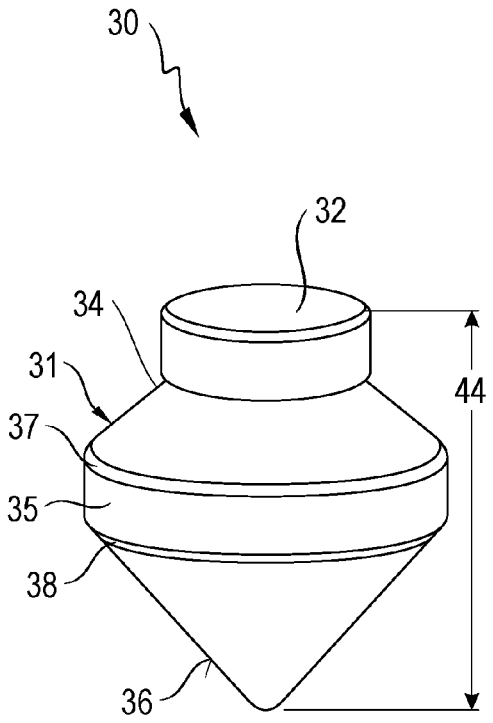
FIG. 2 shows a side view (FIG. 2A) of a second exemplary embodiment of a centrifuge vessel and a top view thereof (FIG. 2B)
Figure 2B:
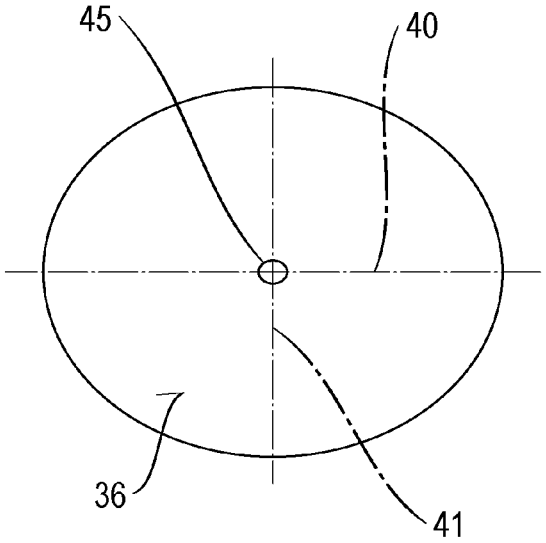

FIG. 2 shows a second exemplary embodiment of a centrifuge vessel 30, in which FIG. 2A is a side view of the centrifuge vessel 30 and FIG. 2B is a bottom view of the centrifuge vessel 30. The centrifuge vessel 30 comprises a vessel body 31 comprising an opening that can be sealed by means of a lid 32, in this case a screw-on closure element. For this purpose, the closure element 32 is of a circular cross-section 33. A top portion 34 of the centrifuge vessel merges continuously by way of a first transition zone 37 into a middle portion 35. The middle portion 35 merges continuously by way of a second transition zone 38 into the bottom portion 36. The vessel body 31 has an oval cross-sectional area 39 in its middle portion 35. This oval cross-sectional area 39 is formed in the top portion 34 starting from the circular cross-section 33 that is in the form of a circular opening of the vessel body 31. Furthermore, the bottom portion 36 of the vessel body 31 is of a conical shape that tapers downwardly from the oval cross-sectional area 39 in the middle portion 35 to form a conical bottom portion 36.

FIG. 2B shows the conical bottom region 36, as viewed from the bottom end of the vessel body 31, which bottom end comprises a tip 45, the center of which is aligned with the center point 42 of the oval cross-sectional area 39 in the middle portion 35. The oval cross-sectional area 39 is delimited by an ellipsoidal perimeter, the longitudinal and transverse axes 40, 41 of which are shown in FIG. 2B.

Compared with the exemplary embodiment as shown in FIG. 1, the second exemplary embodiment as shown in FIG. 2 does not have a flat bottom area 36 so that the centrifuge vessel shown in FIG. 2 is placed, for example, in a supporting storage device that comprises a supporting opening and accommodates the conical portion. The centrifuge vessel 30 is retained in the supporting opening by means of the widest oval cross-section 39 in the middle portion 35. A similar supporting means may be provided for the centrifuging process itself, which supporting means can be in the form of an adapter 50.

To summarize, FIGS. 1 and 2 show exemplary embodiments of a centrifuge vessel 30 that is in the form of a bottle having an oval cross-sectional area 39 composed of semicircular areas (FIG. 1) or in the form of an ellipse (FIG. 2). Tangential transition regions adjacent to the parallel side walls 45 of the vessel body 31 are present on the bottom portion 36 in the exemplary embodiment as shown in FIG. 1. In the embodiment as shown in FIG. 2, the bottom portion 36 of the bottle 30 is conical in shape. The angle of the cone is not everywhere constant but varies with the basic shape of the bottle such that the cone terminates at the vertical surface 45 of the vessel body 31.

Both of the embodiments shown in FIG. 1 and FIG. 2 have the advantage that the bottle 30 allows for a sample to be easily removed from the bottom portion 36 of the bottle 30, since corners are avoided. In both of the exemplary embodiments, the shape allows for optimization of the capacity, and at the same time of the size, of the centrifuge vessel 30, that is to say, the bottle. The centrifuge vessel 30 does not have any corners in the bottom portion 36 and in the opening 34 or in the neck of the bottle. Thus it has now been made possible to develop rotors having maximum volume for a minimum overall diameter. The advantages of the geometry of the present invention are smaller device dimensions, less friction during rotation as compared with angled centrifuge vessels and thus reduced power consumption with an enhanced capacity of the centrifuge vessel 30.

Figure 3:
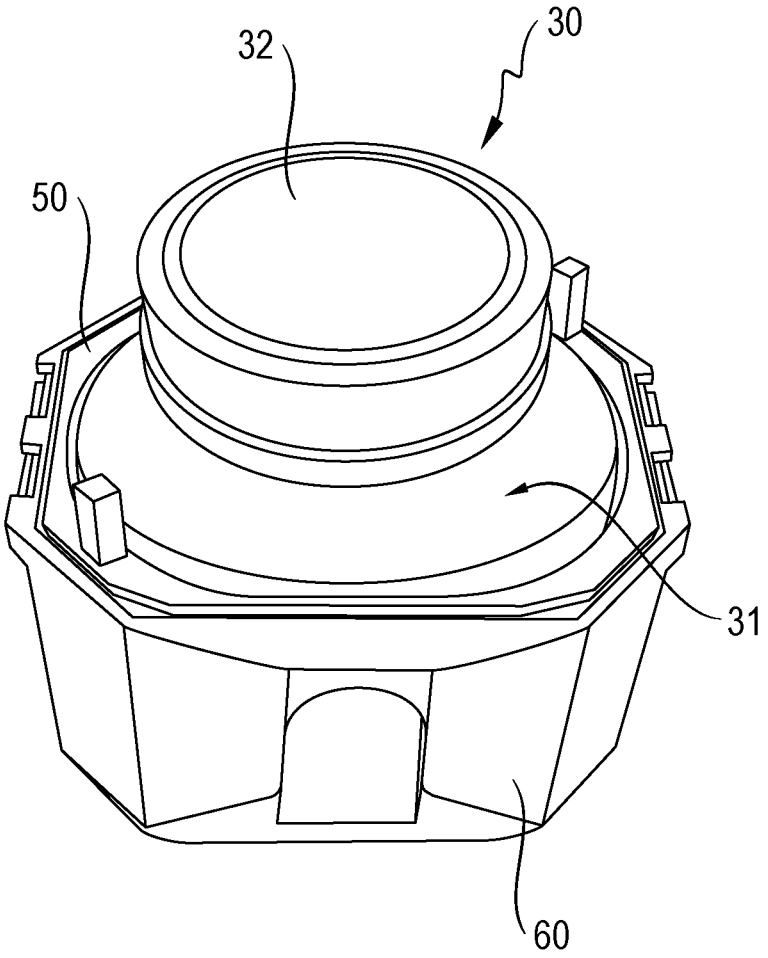
FIG. 3 shows the first exemplary embodiment of the centrifuge vessel as illustrated in FIG. 1 in the mounted state.

FIG. 3 shows the first exemplary embodiment of the centrifuge vessel 30 comprising the vessel body 31 and the closure element 32, as shown in FIG. 1, in the mounted state. In this case, the centrifuge vessel 30 is accommodated by an adapter 50 that is capable of being attached to a centrifuge holding means 60. The centrifuge vessel 30 is mounted by means of the adapter 50 on the centrifuge holding means 60 so as to be rotatable during the centrifuging process, while the adapter 50 can transfer additional forces on account of its resilient properties. The holding means 60 can be fixed to the rotor of a centrifuge (not shown) at the attachment means 61 located at the small sides of the holding means. When fixed to the swinging bucket rotor of a centrifuge, the small sides of the centrifuge vessel 30, of the adapter 50 and of the holding means 60 will face the direction of rotation, indicated by the arrow R, and the centrifuge vessel assembly will swing out via their long sides, in the direction of the arrow S. Principally, however, it would also be possible to turn the arrangement by 90° so that the holding means 60 is attached at its long sides, which face the direction of rotation, and the centrifuge vessel assembly swings out over its small side.

In addition, FIG. 4 shows the exemplary embodiment illustrated in FIG. 3 in the demounted state, in which FIG. 4A shows the centrifuge vessel 30 comprising the vessel body 31 and the closure element 32, FIG. 4B shows the adapter 50, and FIG. 4C shows the centrifuge holding means 60. The adapter 50 and the holding means 60 are cup-shaped, and their inner contour corresponds to the outer contour of the parts accommodated therein. That is, the walls defining the adapter's hollow space are formed such as to support the bottom and side walls of the centrifuge vessel 30 while the walls defining the inner space of the holding means 60 surround and support the bottom and side walls of the adapter 50. Accordingly, a centrifuge vessel 30 having relatively thin walls can be supported in the centrifuge vessel assembly of the present invention.

While the present invention has been illustrated by description of various embodiments and while those embodiments have been described in considerable detail, it is not the intention of Applicants to restrict or in any way limit the scope of the appended claims to such details. Additional advantages and modifications will readily appear to those skilled in the art. The present invention in its broader aspects is therefore not limited to the specific details and illustrative examples shown and described. Accordingly, departures may be made from such details without departing from the spirit or scope of Applicant's invention.

What is claimed is:

1. A centrifuge vessel assembly for use in a centrifuge, comprising:

a centrifuge vessel for holding a sample to be centrifuged;

an adapter holding the centrifuge vessel, said adapter consisting of a one-piece part made from an elastic material; and a holding device holding the adapter for attaching the centrifuge vessel assembly to a rotor of the centrifuge, said centrifuge vessel having a vessel body including a side wall and a sealable opening through which the sample to be centrifuged can be filled into said vessel, said vessel body being fabricated from a plastics material as a single unit by blow molding, said vessel body having a cross-sectional area and a vessel height, said vessel height being oriented at right angles to said cross-sectional area, said adapter including an interior space having a cross-sectional area, said adapter being configured to adapt to a form of the centrifuge vessel and the holding device, wherein said cross-sectional area of said vessel body is in the form of an oval cross-sectional area, and wherein said cross-sectional area of said interior space of said adapter is in the form of an oval cross-sectional area, said interior space of said adapter being made to follow an outer contour of said centrifuge vessel so as to support an outer surface of said centrifuge vessel at least in a region of said side wall.

2. The centrifuge vessel assembly according to claim 1, wherein said cross-sectional area of said vessel body is ellipsoidal.

3. The centrifuge vessel assembly according to claim 1, wherein said cross-sectional area of said vessel body is in the form of two semicircular areas that are joined together by a rectangular area.

4. The centrifuge vessel assembly according to claim 3, wherein said vessel body possesses a bottom surface that comprises said oval cross-sectional area.

5. The centrifuge vessel assembly according to claim 1, wherein said vessel body possesses a middle region that has said oval cross-sectional area.

6. The centrifuge vessel assembly according to claim 1, wherein said vessel body comprises a side wall having a side wall height, wherein said oval cross-sectional area is constant over the entire side wall height.

7. The centrifuge vessel assembly according to claim 1, wherein said vessel body comprises a conical bottom region.

8. The centrifuge vessel assembly according to claim 7, wherein said conical bottom region merges into a side wall that delimits said oval cross-sectional area.

9. The centrifuge vessel assembly according to claim 1, wherein the centrifuge vessel has a capacity of from 750 milliliters to 1000 milliliters.

* * * * *